US006452557B1

(12) United States Patent
Twort

(10) Patent No.: US 6,452,557 B1
(45) Date of Patent: Sep. 17, 2002

(54) ANTENNA ARRANGEMENT FOR A VEHICLE WINDOW

(75) Inventor: Keith Jeremy Twort, Cheshire (GB)

(73) Assignee: Glass Antennas Technology Limited, Manchester (GB)

( * ) Notice: Subject to any disclaimer, the term of this patent is extended or adjusted under 35 U.S.C. 154(b) by 0 days.

(21) Appl. No.: 08/849,201

(22) PCT Filed: Nov. 30, 1995

(86) PCT No.: PCT/GB95/02800

§ 371 (c)(1),
(2), (4) Date: Aug. 21, 1997

(87) PCT Pub. No.: WO96/17399

PCT Pub. Date: Jun. 6, 1996

(30) Foreign Application Priority Data

Dec. 1, 1994 (GB) ..... 9424279

(51) Int. Cl.[7] ..... H01Q 1/32
(52) U.S. Cl. ..... 343/713; 343/848
(58) Field of Search ..... 343/704, 711, 343/713, 808, 809, 858, 712, 846, 848; H01Q 1/32

(56) References Cited

U.S. PATENT DOCUMENTS 3,771,159 A * 11/1973 Kawaguchi et al. ..... 343/713
3,945,014 A * 3/1976 Kunert et al. ..... 343/713
4,072,954 A * 2/1978 Comastri et al. ..... 343/713
4,129,874 A 12/1978 Luedtke et al.
4,727,377 A 2/1988 Yotsuya et al.
5,255,002 A * 10/1993 Day ..... 343/713
5,353,039 A * 10/1994 Tsukada et al. ..... 343/713

FOREIGN PATENT DOCUMENTS

| | | |
|---|---|---|
| DE | 36 19 704 2 C | 12/1987 |
| DE | 37 38 226 A1 | 5/1989 |
| EP | 0 353 378 A1 | 2/1990 |
| EP | 0 500 380 A1 | 8/1992 |

* cited by examiner

*Primary Examiner*—Tho Phan
(74) *Attorney, Agent, or Firm*—Shoemaker and Mattare

(57) ABSTRACT

There is disclosed an antenna arrangement for a vehicle window, particularly suitable for reception of signals in the UHF band while minimising the effect of fast fading. The antenna comprises antenna elements which generate at least two orthogonal or largely orthogonal modes. In reception, one or other mode may be selected such that the antenna effectively operates as a diversity antenna. Alternatively, the two modes may be combined to tailor the polarisation and directional properties of the antenna. For transmission, the properties of the antenna can be tailored to interact favourably with a particular vehicle to which it is applied. These properties may be controlled by a suitable combining circuit.

16 Claims, 4 Drawing Sheets

ANTENNA ARRANGEMENT FOR A VEHICLE WINDOW

BACKGROUND OF THE INVENTION

This invention relates to an antenna arrangement for a vehicle window.

It has increasingly become a requirement for equipment within vehicles to be able to transmit and receive in the UHF band, for example, for use in connection with cellular telephone, satellite navigation systems or for other uses.

Commonly, to provide for UHF reception, a vehicle is provided with a whip antenna which is in length a multiple of one quarter of the wavelength of the signal to be received. Alternatively, a single vertical stub antenna may be mounted on a window, usually the rear window of the vehicle.

A problem with the arrangements described above is that antennas are subject to multipath reception which leads to fast fading of the signal received, which, in the case of an audio signal, causes a general "break-up" in reception. Multipath reception is a consequence of signals being received by the antenna both directly from a transmission source and after reflection from different surfaces. Commonly, such surfaces include walls of building in a built-up urban environment.

SUMMARY OF THE INVENTION

It is an aim of the present invention to provide an antenna arrangement in which the effect of fast fading upon the quality of the received signal can be reduced.

According to a first aspect of the present invention therefore there is provided An antenna comprising receiving elements and a base element the base element acting as a ground plane or as a counterpoise resonant element, each of which elements are formed of electrically-conductive material, characterised in that the receiving elements are formed as conductive strips, angled to one another and to the ground plane, and in that signals from the antenna may be derived from two outputs corresponding respectively to the sum and the difference of outputs of the receiving elements, whereby the antenna is operable in orthogonal modes when placed on a window pane.

The modes being suitable for providing diversity reception at high frequencies, output signals being sourced selectively from whichever mode provides the stronger output signal. This arrangement at least mitigates, the abovementioned fast fading problems associated with previously used arrangements.

Signals may be fed to and from the modes by means of a hybrid element, which, in operation, permits the modes to be combined without affecting the operation of the antenna itself. The hybrid element may comprise a wound transformer or a conductive ring structure.

The ground plane may be constituted by an edge of the window or alternatively may comprise a conductive ground strip printed on the window. More preferably, a tuned conductive element is provided (to constitute a counterpoise resonant element) instead of the ground plane.

The antenna may have two elements symmetrically inclined about a median plane which extends normal to an centrally of the ground plane or the resonant element, as the case may be.

In a preferred form, each element comprises a loop of conductive material. A first end of each loop may be connected to the base element, second ends of the loops being interconnected at a common point. In such embodiments, signals may be fed to and/or from the antenna at the common point.

In an alternative mode of operation of an antenna embodying the invention, the two modes are operable separately or in combination through a hybrid element, signals being connected with the antenna through a circuit operative to combine the two modes in appropriate phase and amplitude to produce, in effect, single antenna of an optimised performance. As will be discussed below, this mode of operation is particularly advantageous when the antenna is to be used to transmit signals.

In some circumstances, the two modes may each exhibit resonance two or more at substantially different frequencies, so enabling reception and/or transmission of signals in different frequency bands.

An antenna embodying the invention may be used in combination with a switching circuit whereby the antenna is operable as an adaptive antenna system having directional characteristics variable in real time under automatic control.

Most advantageously, an antenna embodying the invention is formed as a pattern of conductors printed onto a glass pane. These conductors may be formed at very low cost as part of the process whereby a heater is formed on the pane. In such embodiments, a portion of the pattern may constitutes a hybrid element, and a further portion of the pattern may constitute an impedance matching element.

An antenna embodying the invent ion may be provided as part of an antenna system in combination with another antenna.

Although it is not possible to use a diversity antenna system for transmission, the antenna of the present invention is advantageous when used as a transmission antenna. A major problem associated with transmission of high-frequency signals from vehicles arises from the interaction between the antenna and the conductive vehicle body. It has been found in practice that the nature of the interaction varies substantially from one model of vehicle to another, with the consequence that it has not hitherto been possible to produce a generic transmission antenna optimised for use in a wide range of vehicles.

In a second of its aspects the invention provides a transmission antenna comprising an antenna according to the first aspect of the invention, and a combining and tuning circuit, in which the combining and tuning circuit adjusts the directional and bandwidth characteristics of the antenna to the vehicle with which it is intended for use.

Thus, a common antenna can be used on a wide range of vehicles, it being necessary to tailor only the combining and tuning circuit to the characteristics of the vehicle.

As will be appreciated by those skilled in the art, a transmission antenna which has two separably operable orthogonal modes can, with suitable combining and tuning, exhibit an extremely diverse range of directional, polarisation and other characteristics. Such a circuit typically imposes a phase shift or a delay in the signal fed to one of the modes with respect to the other, and which after combination effects a relative difference in the magnitudes of the signals.

BRIEF DESCRIPTION OF THE DRAWINGS

Embodiments of the invention will now be described in detail, by way of example, with reference to the accompanying drawings in which.

DESCRIPTION OF THE PREFERRED EMBODIMENTS

Figure 1A:
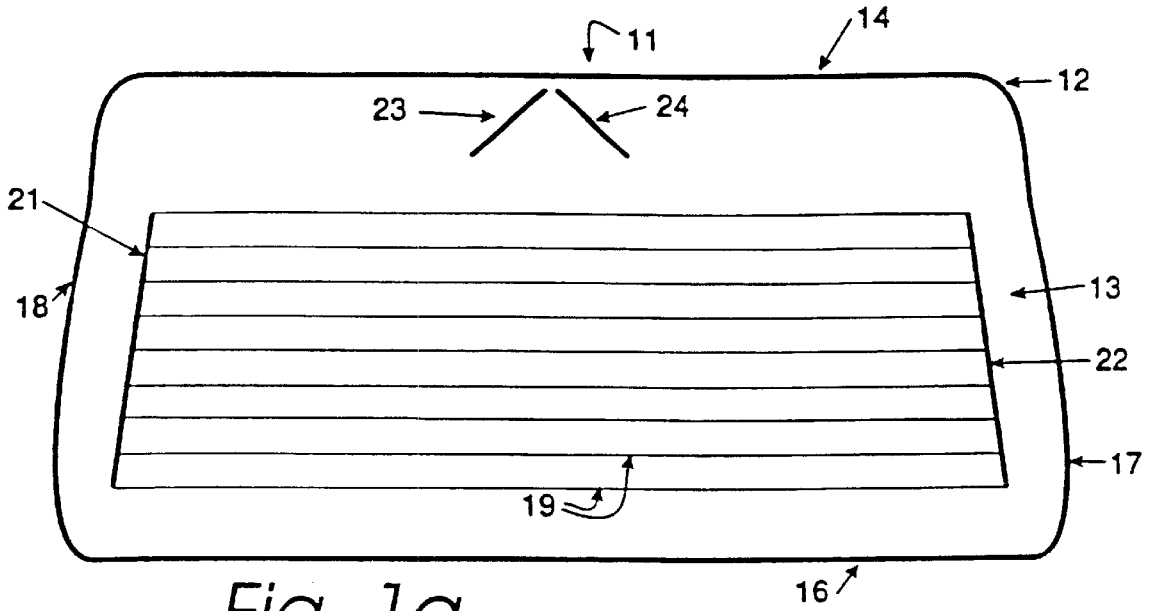
FIGS. 1*a* and 1*b* show schematic views of two forms of antenna applied to a car window.
Figure 1B:
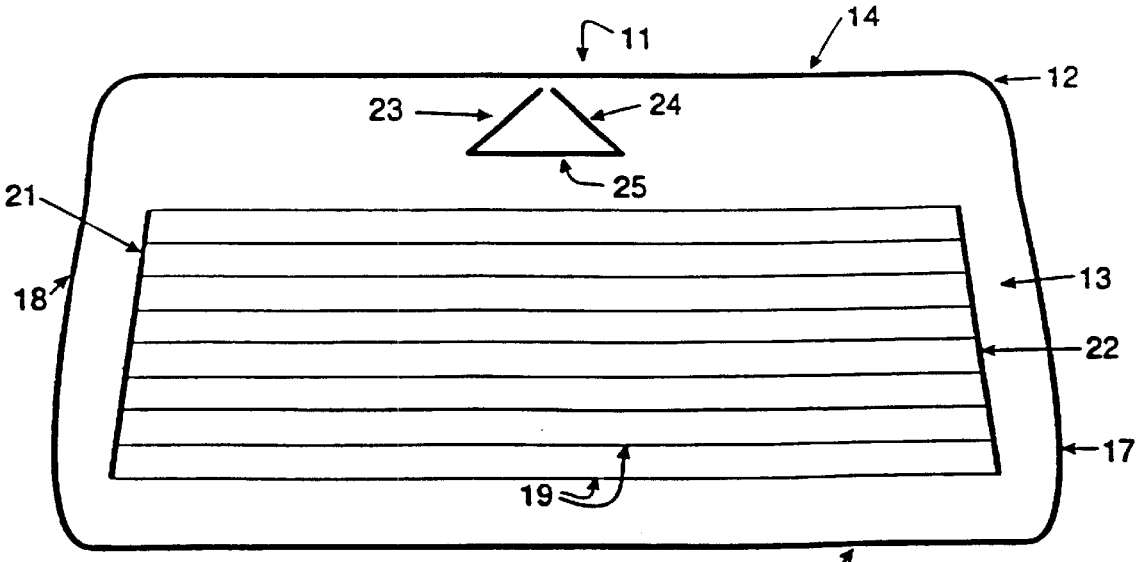
Figure 2:
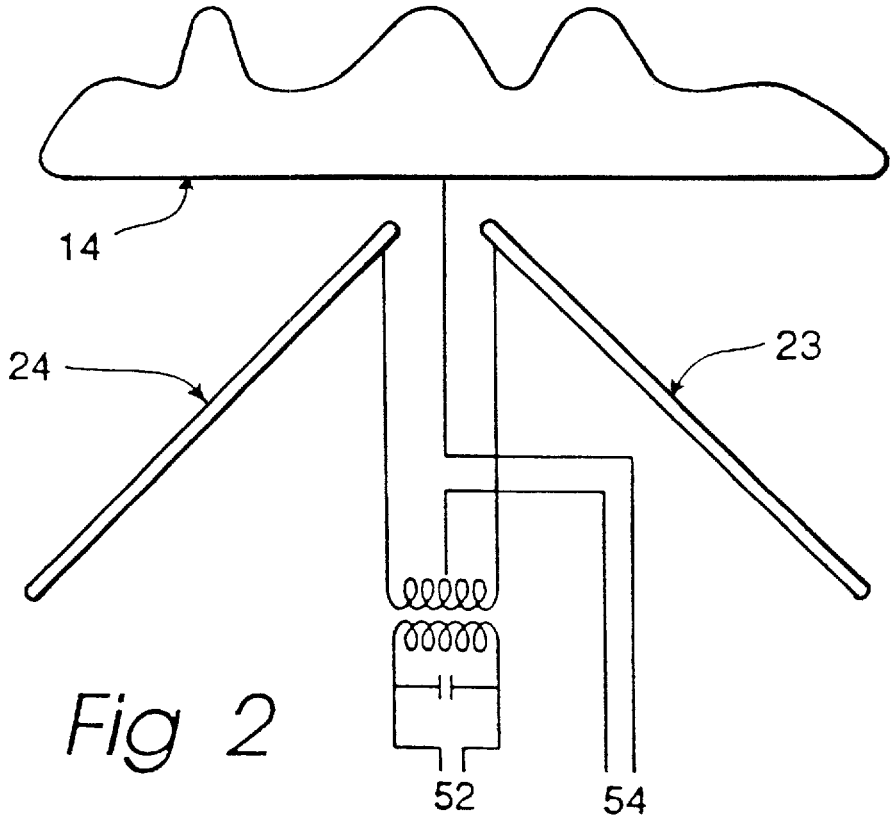
FIG. 2 shows a schematic representation of a circuit including the antenna of FIG. 1 for receiving signals from a remote source.
Figure 3:
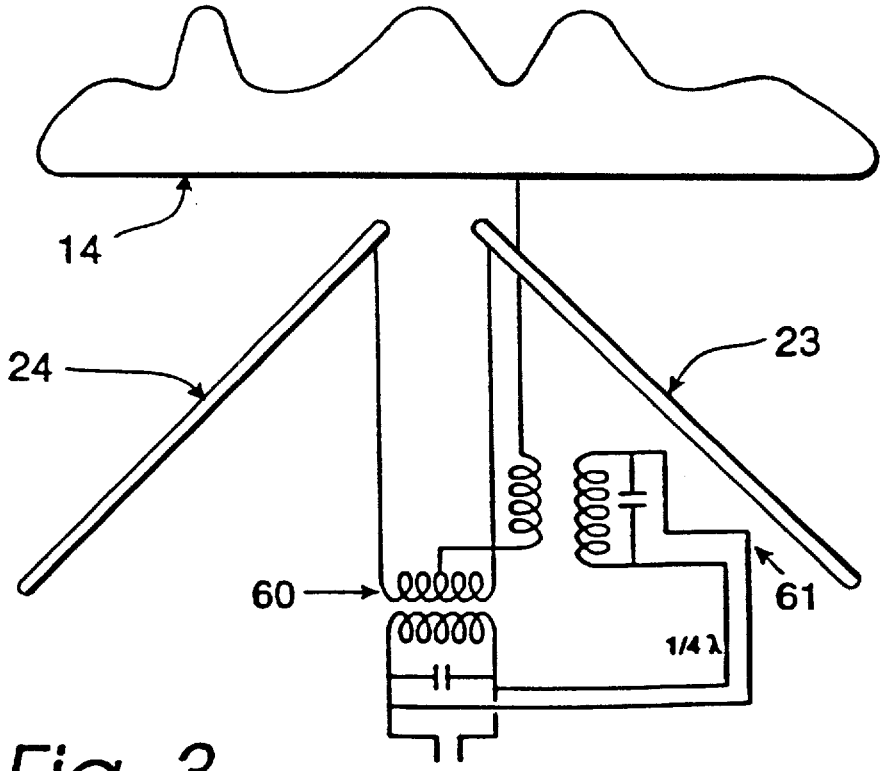
FIG. 3 shows a schematic representation of a circuit including the antenna of FIG. 1 for transmitting signals to a remote source.

Referring now to the FIGS. 1 to 3, there is shown in FIG. 1 an antenna arrangement 11 embodying the invention applied to a window 12 of a vehicle. The window 12 shown is a rear window of a motor car, although it is to be understood that the invention can be applied to any suitable window of any suitable vehicle.

The window 12 comprises a glass pane which is generally rectangular or trapezoidal (depending upon its application). The pane 13 has top and bottom long edges 14, 16 which typically extend approximately horizontally, and two short upright side edged 17, 18. The pane 13 may be flat or curved and may lie in a plane (or is curved relative to a plane) which is substantially vertical no is inclined to the vertical, as is conventional. The pane 13 fits within an opening in a metal body of the vehicle and in sealed against water and air penetration relative to the periphery or the opening with a scaling gasket formed from rubber or similar material, or a suitable adhesive.

The pane 13 typically incorporates a heater, the prime purpose of which is to demist and defrost it, but which may also be used as an antenna for receiving radio signals. The heater comprises a series of parallel, horizontal conductors 19, running between upright bus bars 21, 22. The conductors and bars are formed on the inner surface of the glass pane 13 for example, being applied thereto as narrow, flat, printed, conductive strips. The bus bars 21, 22 are connected to the d.c. power supply of the vehicle via an operating switch. As is common in vehicle electrical practice, one bus bar is connected to the vehicle earth (i.e. the car body which is directly connected to the negative terminal of the vehicle's battery) and the other bus bar is connected by a lead to a positive supply via an operating switch which may be located for example on the vehicle dashboard.

The heater conductors 19 extend across a major part of the surface area of the window pane but there is a region between the top edge 14 of the window pane 13 and the uppermost heater conductor 19 in which no such heater conductors 19 are provided. In this region there are two straight antenna conductors 23, 24 (see FIG. 1*a*) which are inclined relative to each other having an angle of substantially 90° therebetween. The antenna conductors 23, 24 are also inclined relative to the upper edge 14 of the window 13 at an angle of 45°. The antenna conductor 23, 24 are incorporated in or are applied to the inner surface of the pane 13, most advantageously being formed in the same manner as the heater. The antenna conductors 23, 24 may comprise a 0.4 mm wire fixed by adhesive to the surface of the pane, or the conductors may comprise a narrow flat printed conductive strip, say 1 to 1½ mm wide.

The conductors 23, 24 are relatively short being significantly shorter than the edges of the window frame.

In this embodiment, each of the antenna conductors 23, 24 resonates in with respect to a ground plane constituted by the conductive vehicle body adjacent the window aperture. The modes of resonance of the two antenna conductors 23, 24 are substantially orthogonal.

In FIG. 1*b*, an alternative form of antenna arrangement is shown in which ends of the antenna conductors 23, 24 remote from the edge 14 of the window are linked by a third conductor 25 forming a loop. It has been found that the provision of such a loop can advantageously modify the impedance and directional characteristics of the antenna which can otherwise not be optimal.

As shown in FIG. 2, if the antenna is to be used for reception, its antenna conductors 23, 24 can conveniently be connected via a hybrid transformer arrangement 50 to radio reception apparatus to act as an antenna therefor. The operation of the hybrid transformer 50 is such that it combines the output from the two antenna conductors 23, 24 to provide two outputs at 52 and 54 respectively which are orthogonal to one another or have a substantial orthogonal component. Additionally, it is a property of the hybrid arrangement that neither mode interacts with the other.

The outputs from each of the antenna conductors 23, 24 are added in phase by the transformer arrangement 50 to produce r.f. current vector in the antenna at right angles to the edge 14 of the window or are subtracted out of phase to a net r.f. current vector essentially parallel to the edge 14 of the window. As these two phases of polarisation produce an orthoqonal r.f. field, they are totally independent and thus cannot interfere with one another.

In use, the stronger one of the two outputs 52, 54 an be selected (for example, by a high-speed automatic charge switch controlled by a signal strength detector) to give, effectively, a diversity reception. This can reduce the effect of fast fading due to multipath propagation of the received signals.

FIG. 3 shows one circuit arrangement 60 suitable for use when the antenna is being used to transmit signals to a remote site. In this case, the inputs to one of the orthogonal modes of the antenna conductors 23, 24 are fed through a quarter-wavelength delay (in this case, a length of feeder 61 as shown in the figure) with respect to the other mode. This arrangement gives a signal which is circularly or elliptically polarised and this is compatible with a wide range of polarisations of the remote site. As will be readily appreciated, the relative phases and amplitudes of the signals fed to the two modes could be varied in other ways to effect a wide variety of directional and polarisation properties of the antenna.

In applying to a vehicle an antenna as described in the last preceding paragraph, the circuit arrangement 61 may be designed to account for the effect of the conductive parts of the vehicle. In this manner, tho performance of the antenna as a transmitting antenna can be adjusted to offer an optimised performance characteristic.

Figure 4:
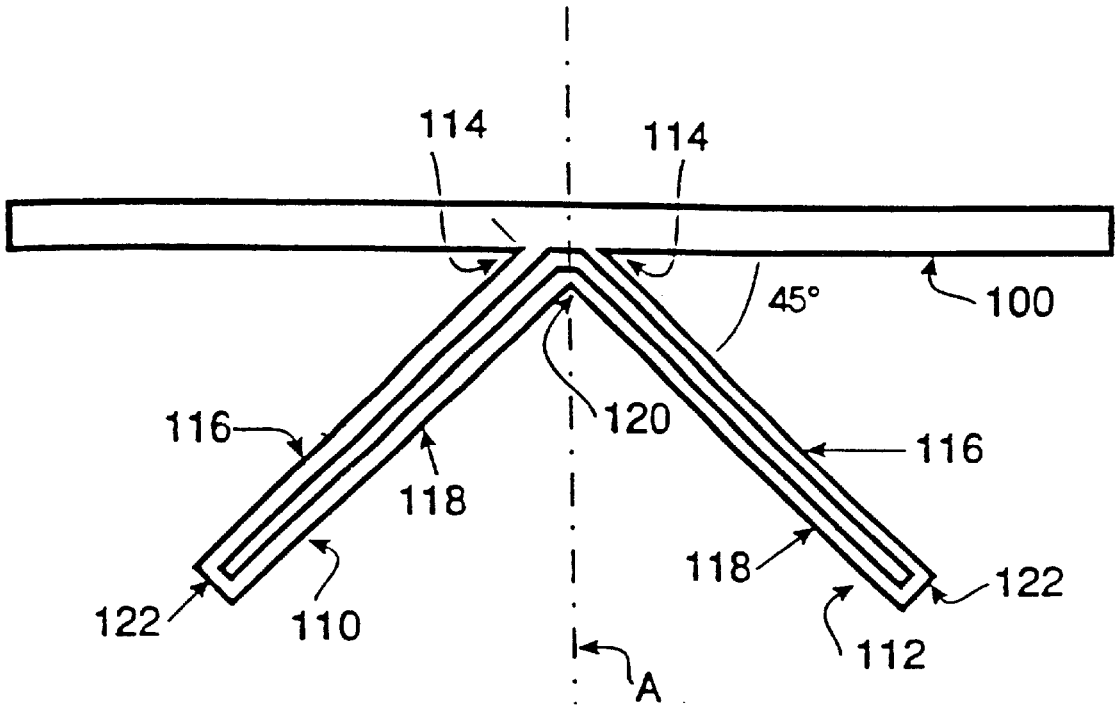
FIG. 4 shows an antenna being alternative embodiment of the present invention.

An alternative embodiment of the invention is illustrated in FIG. 4. This embodiment may provide a more appropriate impedance over a wider bandwidth as compared with the above described embodiment.

It will be appreciated that the vehicle body is only an approximation to a ground plane. In some cases, the deviation from a truly aperiodic ground state is sufficient to cause maloperation of the antenna due to resonances inherent in the body adjacent the antenna. As this may be disadvantageous to the performance of the antenna, an aim of this embodiment is to ameliorate this effect.

The antenna comprises a base element 100 being a rectangular conductive strip, intended to be disposed substantially horizontally. A hypothetical median plane A can be defined to intersect the base element 100 at its mid-point, and to extend normal to the base element 100.

First and second antenna conductors 110, 112 extend from the base element 100 each at an angle of 45° to it. The antenna conductors 110, 112 diverge from approximately the intersection of the base element 100 and the median plane A.

Each of the antenna conductors 110, 112 comprises a loop of conductive material. A first part 116 of the loop is electrically connected to the base element 100, as at 114, and extends at 45° from it. A second part 118 of the loop extends parallel to and spaced from the first part 116 to interconnect with the second part 116 of the loop of tho other of the antenna conductors at a common point 120. A short bridging element 122 interconnects the first and second parts 116, 118 to complete the loop.

The common point 120 constitutes a feed point at which signals may be fed to and from the antenna. A coaxial feeder (not shown) may be used, its screen being connected to the mid-point of the base element 100.

The base element 100 serves as a counterpoise resonant element to the antenna conductors 110, 112. This effectively isolates the antenna conductors 110, 112 from the effects of the vehicle body.

The following dimensions have been used in one embodiment. Base element: 118 mm×5 mm; and antenna conductors each 51 mm long, 1.5 mm wide, and separated by 1 mm. These have been found to be applicable for use with signals in the range 870 to 960 MHZ.

Figure 5:
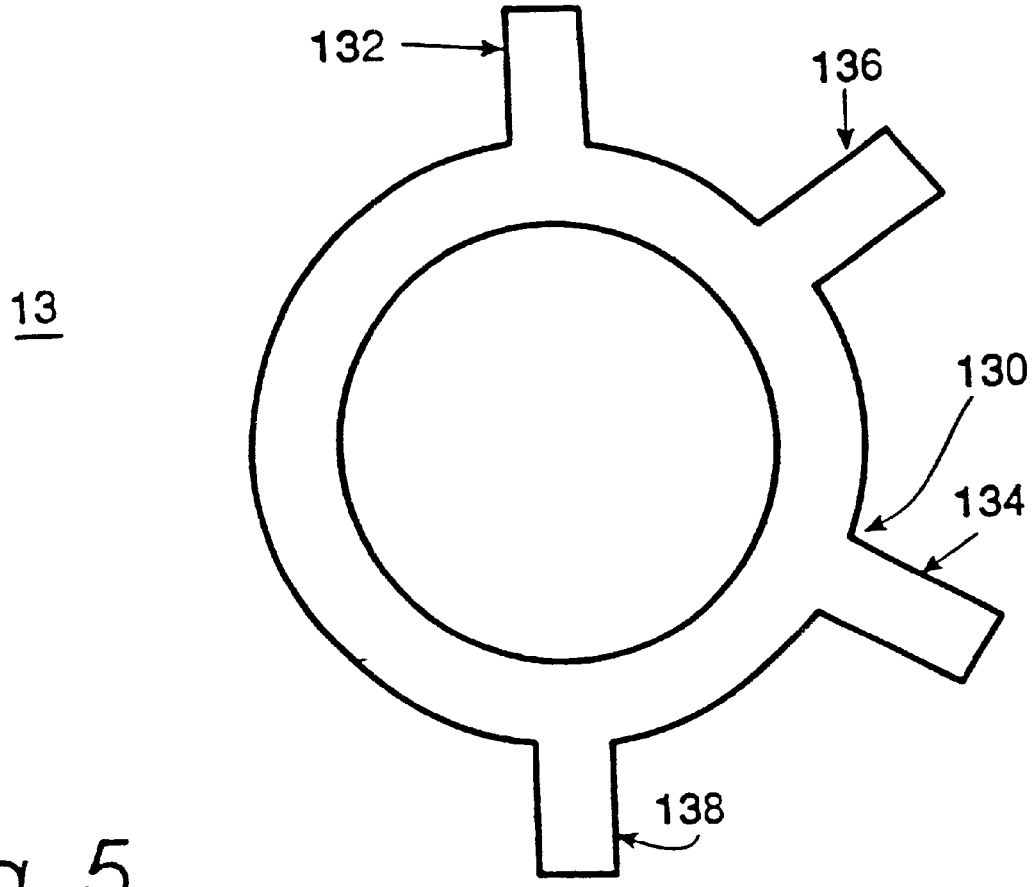
FIG. 5 shown an alternative hybrid structure suitable for use in an antenna embodying the invention.

With reference to FIG. 5, an alternative hybrid structure is shown which can be conveniently formed as a conductive element printed on the glass in the same process in which the heater and the antenna conductors are formed.

The hybrid structure comprises a conductive ring 130 printed onto the glass pane 13. The length of the ring is equivalent to 1.5 times the wavelength of the signals to be received when propagating in the glass of the window pane 13.

A signal from a first of the modes is fed into the ring through a first feed conductor 132, while a signal from a second of the modes is fed into the ring through a second feed conductor 134. The first and second feed conductors 132, 134 connect to the ring 130 spaced apart by a distance equal to one half of the wavelength of the signals. First and second output conductors 136, 138 connect to the ring 130 at, respectively, a point half-way between the first and the second feed conductors 132, 134 and a point opposite the first feed conductor 132.

If it is assumed that mode A is fed through the first feed conductor 132 and that orthogonal mode B is fed through the second feed conductor 134, then it can be shown that (a) the first feed 132 conductor is not affected by signals injected by the second feed conductor 134; (b) the first output 136 carries a signal equivalent to A+B; and (c) the second output 138 carries a signal equivalent to A−B. This, it will be seen, is functionally equivalent to the circuit of FIG. 2.

It is of course to be understood that the invention is not intended to be restricted to the details of the above embodiments which are described by way of example only.

What is claimed is:

1. An antenna comprising at least two receiving elements and a base element acting as a ground plane or as a counterpoise resonant element, each of said elements being formed of electrically conductive material, wherein the receiving elements are formed as conductive strips, angled to one another and to the ground plane, whereby signals from the antenna may be derived from two outputs corresponding respectively to the sum and the difference of outputs of the receiving elements, and the antenna is operable in orthogonal modes when placed on a window pane.

2. An antenna according to claim 1, wherein the base element comprises a conductive region of material adjacent the window pane.

3. An antenna according to claim 1, wherein the base element comprises a conductive element on the window pane.

4. An antenna according to claim 1, wherein the two receiving elements are symmetrically inclined about a median plane extending normal to the base element at the mid-point of the base element.

5. An antenna according to claim 1, wherein each receiving element comprises a loop of conductive material.

6. An antenna according to claim 5, wherein a first end of each loop is connected to the base element, and second ends of both loops are interconnected at a common point.

7. An antenna according to claim 6, wherein signals are fed to and/or from the antenna at the common point.

8. An antenna according to claim 1, wherein the two modes are operable separately or in combination through a hybrid element, signals being connected with the antenna through a circuit operative to combine the two modes in appropriate phase and amplitude to produce a virtual single antenna of an optimized performance.

9. An antenna according to claim 1, further comprising a selection means to arrange for an output signal to be taken from the mode which produces the stronger signal.

10. An antenna according to claim 1, wherein the two modes are each resonant at two or more substantially different frequencies.

11. An antenna according claim 1, in combination with a combining circuit whereby the antenna is operable as an adaptive antenna system having directional and/or polarization characteristics variable in real time under automatic control.

12. An antenna according to claim 1, wherein said elements are formed as a pattern of conductors printed onto a glass pane forming a window of a motor vehicle.

13. An antenna according to claim 12, wherein a portion of said pattern constitutes a hybrid element.

14. An antenna according to claim 12, wherein a portion of said pattern constitutes an impedance matching element.

15. An antenna according to claim 1, in combination with another antenna, said antennas together forming an antenna system.

16. An antenna according to claim 1, further comprising a tuning circuit which tunes the characteristics of the antenna to a vehicle on which it is intended to be used, whereby the antenna may be used as a transmission antenna.

* * * * *